US009901199B2

(12) United States Patent
Maple et al.

(10) Patent No.: US 9,901,199 B2
(45) Date of Patent: Feb. 27, 2018

(54) LIQUID DISPENSING LID

(71) Applicants: Wade Maple, Spokane, WA (US); Jeff Steininger, S. Mary's, OH (US)

(72) Inventors: Wade Maple, Spokane, WA (US); Jeff Steininger, S. Mary's, OH (US)

(73) Assignee: Zak Designs, Inc., Spokane, WA (US)

( * ) Notice: Subject to any disclaimer, the term of this patent is extended or adjusted under 35 U.S.C. 154(b) by 175 days.

(21) Appl. No.: 14/604,495

(22) Filed: Jan. 23, 2015

(65) Prior Publication Data

US 2016/0213178 A1 Jul. 28, 2016

(51) Int. Cl.

| | |
|---|---|
| ***B65D 47/08*** | (2006.01) |
| ***B65D 47/24*** | (2006.01) |
| ***A47G 19/22*** | (2006.01) |

(52) U.S. Cl.

CPC ..... *A47G 19/2272* (2013.01)

(58) Field of Classification Search

CPC ..... B65D 2543/00046; B65D 51/18

USPC ..... 220/714, 715, 348, 254.4, 254.3, 282, 220/262, 264, 203.19, 203.01, 203.04, 220/254.1, 254.5, 254.6, 254.9, 256.1, 220/259.1, 281, 713; 215/351, 342, 315, 215/311, 307, 341, 350, 352; 222/561, 222/560, 559, 472, 471, 470, 544

See application file for complete search history.

(56) References Cited

U.S. PATENT DOCUMENTS

| | | | | |
|---|---|---|---|---|
| 3,967,748 A * | 7/1976 | Albert | B65D 47/249 215/307 |
| 6,648,158 B1 * | 11/2003 | Lawrence | B65D 55/16 215/306 |
| 8,056,745 B2 * | 11/2011 | Yu | A47J 41/0027 215/356 |
| 8,360,258 B2 * | 1/2013 | Gilbert | A47G 19/2272 220/203.05 |

* cited by examiner

*Primary Examiner* — J. Gregory Pickett
*Assistant Examiner* — Allan Stevens
(74) *Attorney, Agent, or Firm* — Randall Danskin P.S.

(57) ABSTRACT

A liquid dispensing lid is described and which includes a lid body defining a drinking aperture, and an internal cavity, and wherein the lid body cooperates with a drinking vessel for enclosing a source of a liquid to be consumed, and a fluid regulating plate is provided, and which movably cooperates with the lid body, and which further is operable to move along a path of travel from a first position which impedes the movement of the liquid to the drinking aperture, to a second position which allows liquid to move to the drinking aperture.

15 Claims, 5 Drawing Sheets

LIQUID DISPENSING LID

TECHNICAL FIELD

The present invention relates to a liquid dispensing lid for drinking vessels of various designs, and more particularly to a liquid dispensing lid which regulates the flow of a liquid from the internal cavity of the drinking vessel in a reliable manner, and which further can be readily disassembled and cleansed so as to maintain the liquid dispensing lid in a sanitary condition.

BACKGROUND OF THE INVENTION

Assorted liquid dispensing lids and drinking vessels have been marketed and sold to the general public for many years. At least some of these drinking vessels have been designed for particular purposes such as to be used during athletic competitions, or when an individual is engaged in other athletic pursuits, such as riding a bicycle, running, and other physical activities and where the continual hydration of the participant is desired.

Assorted efforts have been undertaken to develop drinking vessels, and assorted lids utilized with same, and which permit the selective dispensing or consumption of the beverage enclosed within the drinking vessel in a manner which prevents the consumed fluid from inadvertently spilling on the user, or further spilling from the drinking vessel should the drinking vessel be inadvertently overturned during the activity or due to other events such as when the drinking vessel is dropped or overturned as might be occasioned while a person is operating a motor vehicle.

In addition to the foregoing, many users of the aforementioned prior art drinking vessels have employed the drinking vessels to dispense assorted different beverages such as water, coffee, alcoholic beverages, and the like. As should be understood, dispensing carbonated beverages from a drinking vessel, for example, tends to deposit small amounts of this liquid on the exposed surface areas. This residue typically includes sugar-based components and which, when dried, can often create a sticky residue which facilitates the growth of various undesirable microorganisms. If these coated and exposed surfaces are not periodically cleaned, the surfaces may be contaminated to a point where a user can become exposed to undesirable levels of microorganisms thereby causing illness. Still further, this type of contamination in certain designs of liquid dispensing lids may rise to a level where the residue impedes the operation of the liquid dispensing lid and prevents the effective closure or opening of the fluid dispensing lid.

Many designers of drinking vessels have attempted to provide various arrangements for avoiding the problems associated with the coating of exposed surfaces with various residues derived from the fluids which have been dispensed from a drinking vessel. While these various design attempts have operated with varying degrees of success, one of the chief problems associated with these previous prior art designs has been that such liquid dispensing lids have been unduly mechanically complex, and therefore have been quite costly to fabricate, or on the other hand, have often been difficult to disassemble and clean notwithstanding the representations of the designers that such products can be readily disassembled for cleaning so as to maintain them in a sanitary condition.

The present invention avoids the detriments associated with the various prior art practices and products utilized heretofore, and provides a fluid dispensing lid which is easy to operate, is easy to disassemble and reassemble, and further provides a convenient means whereby a user can single-handedly operate the liquid dispensing lid in a manner which allows the user to continue their daily activities whether they be athletic, or otherwise, and can further reliably secure the liquid dispensing lid so as to prevent liquid spills when the liquid dispensing lid and associated drinking vessel is inadvertently overturned, or not in use.

SUMMARY OF THE INVENTION

A first aspect of the present invention relates to a liquid dispensing lid which includes a lid body having a drinking aperture, and which further defines an internal cavity, and wherein the lid body releasably cooperates with a drinking vessel which encloses a source of a liquid to be consumed through the drinking aperture; an actuator assembly moveably mounted within the internal cavity of the lid body, and wherein an external force applied to the actuator assembly moves the actuator assembly along a first path of travel; a fluid regulating plate which movably cooperates with the lid body, and wherein the actuator assembly forcibly engages the fluid regulating plate when the external force is applied to the actuator assembly to move the fluid regulating plate along a second path of travel from a first position which impedes the movement of the liquid to the drinking aperture, to a second position which allows liquid movement to the drinking aperture; and a biasing member mounted on the lid body, and further coupled to the fluid regulating plate, and wherein the biasing member biasingly urges the fluid regulating plate towards the first position along the second path travel when the external force is no longer applied to the actuator assembly.

Still another aspect of the present invention relates to a liquid dispensing lid which includes a lid body having a top surface which has a peripheral edge, a bottom surface, and a downwardly depending sidewall, and wherein the bottom surface and the downwardly depending sidewall define an internal cavity, and wherein a drinking aperture, and a coupling aperture are formed in the top surface, and extend through the lid body to the bottom surface thereof, and wherein an actuator aperture is defined in the downwardly depending sidewall of the lid body; an actuator assembly moveably located within the internal cavity as defined by the lid body, and wherein the actuator assembly includes a first, force receiving member which moveably cooperates with the actuator aperture which is defined by the downwardly depending sidewall of the lid body, and a second force receiving member which is coupled in force receiving relation relative to the first force receiving member, and wherein an external force applied to the first actuator assembly causes the first force receiving member to move in a first, predetermined direction along a first path of travel; a fluid regulating plate which moveably cooperates with the lid body, and wherein the fluid regulating plate has an inwardly facing surface which has a peripheral edge, and wherein the inwardly facing surface further includes a valve member which operably cooperates with the drinking aperture, and wherein a biasing member aperture passes through the fluid regulating plate, and wherein the second force receiving member of the actuator assembly transmits force to the inwardly facing surface of the fluid regulating plate so as to move the fluid regulating plate along a second path of travel from a first position which impedes the movement of a liquid into the internal cavity of the lid body, and out through the drinking aperture, to a second position, and where movement of the liquid through the internal cavity of the lid body is permitted; and a biasing member having a first portion which is mounted on the lid body, and a second portion which is made integral with the first portion, and which further extends through the coupling aperture formed in the top surface, and wherein the biasing member has a distal end which passes through the biasing member aperture which is formed in the fluid regulating plate, and which further exerts a biasing force on the fluid regulating plate so as to move the fluid regulating plate in the direction of the first position along the second path of travel, and to urge the actuator assembly to further move in an opposite direction along to the first predetermined path of travel.

Still another aspect of the present invention relates to a liquid dispensing lid, and which includes a lid body having a top, outwardly facing surface, an opposite bottom facing surface, and which is further defined by a longitudinal axis, and wherein the lid body is also defined, at least in part, by a peripheral edge, and wherein a sidewall extends generally vertically upwardly relative to the peripheral edge of the top surface, and further has a variable height dimension when measured from the top surface of the lid body, and wherein the lid body further has a downwardly extending sidewall which is mounted on the bottom surface, and which depends downwardly relative thereto, and wherein the downwardly extending sidewall has an exterior facing surface, and an opposite interior facing surface, and wherein the downwardly extending sidewall further has a distal peripheral edge which defines an aperture, and wherein the bottom surface of the lid body, and the interior facing surface of the downwardly extending sidewall, in combination, define an internal cavity of the lid body, and wherein the exterior facing surface of the downwardly extending sidewall of the lid body is sized so as to releasably cooperate with a fluid dispensing vessel having an internal cavity and which encloses a source of a liquid to be dispensed, and wherein the lid body further defines a drinking aperture, and a second, coupling aperture, each of which extends through the top and bottom surfaces of the lid body, and further communicate with the internal cavity of the lid body, and wherein the downwardly extending sidewall of the lid body additionally defines an actuator aperture which is located below the top surface of the lid body, and laterally, outwardly, relative to the longitudinal axis thereof; a continuous ring member which matingly, and circumscribingly cooperates, at least in part, with the lid body, and is further positioned laterally, outwardly relative to the longitudinal axis of the lid body, and wherein the continuous ring member further defines an aperture which is substantially coaxially aligned relative to the actuator aperture of the lid body; an actuator assembly which is moveably borne by the lid body, and which is located, at least in part, within the internal cavity of the lid body, and wherein the actuator assembly includes a first, force receiving member which is matingly, and moveably received within the actuator aperture, and which further extends, at least in part, laterally outwardly relative to the peripheral edge of the top surface of the lid body, and wherein an exterior force applied to the first, force receiving member effects an inwardly directed movement of the first, force receiving member in a direction towards the longitudinal axis, and wherein the actuator assembly further includes a second, force receiving member which is coupled to the first, force receiving member, and which further is wholly located within the internal cavity which is defined by the lid body, and wherein the actuator assembly is moveable along a reciprocal, first path of travel, from a first, at rest position, to a second, operational position, and wherein the exterior force applied to the first, force receiving member is effective in moving the actuator assembly along the first path of travel from the first, at rest position, to the second, operational position; a gasket which is fluid-sealingly mounted on, and about, the distal peripheral edge of the downwardly depending sidewall of the lid body, and wherein the gasket is effective in impeding movement of the liquid from the internal cavity of the fluid dispensing vessel into the internal cavity as defined by the lid body when the actuator assembly is in the first, at rest position; a moveable fluid regulating plate having a main body which is defined by an inwardly facing surface, an outwardly facing surface, and a peripheral edge, and wherein a pair of generally vertically upwardly extending, and spaced ribs are mounted on the inwardly facing surface of the main body and which further each have an upper, force receiving edge, and wherein the second force transmitting member of the actuator assembly forcibly cooperates with the upper, force receiving edge of one of the spaced ribs, and wherein a valve member is further mounted on the inwardly facing surface of the moveable base plate and further extends vertically upwardly relative thereto, and wherein a biasing member aperture is formed in, and passes through, the respective inwardly and outwardly facing surfaces of the movable fluid regulating plate, and wherein the moveable fluid regulating plate is further operable to move along a second path of travel from a first position, and where the main body of the moveable fluid regulating plate is positioned in fluid sealing engagement with the gasket member, and further occludes the internal cavity as defined by the lid body, and additionally positions the valve member in occluding relation relative to the drinking aperture as defined by the lid body, to a second position, and wherein in the second position, at least a portion of the main body of the moveable fluid regulating plate is located in spaced relation relative to the gasket member, and the valve member is located in non-occluding relation relative to the drinking aperture, and wherein the moveable fluid regulating plate, when located in the second position along the second path of travel allows the source of the fluid enclosed within the fluid dispensing vessel to pass from the fluid dispensing vessel, into the internal cavity as defined by the lid body, and then pass through the non-occluded drinking aperture, and wherein movement of the actuator assembly from the first, at rest position, to the second, operational position, effects the movement of the moveable fluid regulating plate along the second path of travel from the first position to the second position; and a biasing member having a main body which is mounted on the top surface of the lid body, and which further biasingly cooperates with, and urges the moveable fluid regulating plate in the direction of the first position, and which is located along the second path of travel, and where, in the first position, the fluid regulating plate sealingly engages the gasket member, and wherein the main body of the biasing member has a first portion which is supported on the lid body, and is further located near the top surface thereof, and wherein the biasing member further includes a second, elongated portion which is made integral with the first portion, and which further has a distal end, and wherein the second portion depends downwardly relative to the first portion, and further passes through the coupling aperture, and extends through the internal cavity of the lid portion, and wherein the distal end of the second portion further extends through the biasing member aperture, and forcibly cooperates with the fluid regulating plate, and wherein the movement of the moveable fluid regulating plate along the second path of travel from the first position, to the second position, is effective in forcibly elongating the second portion of the biasing member, and wherein the fluid regulating plate moves along the second, arcuately shaped path of travel from the second position to the first position under the biasing force exerted by the second portion of the biasing member when the exterior force is no longer applied to the first portion of the actuator assembly.

These and other aspects of the present invention will be described in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
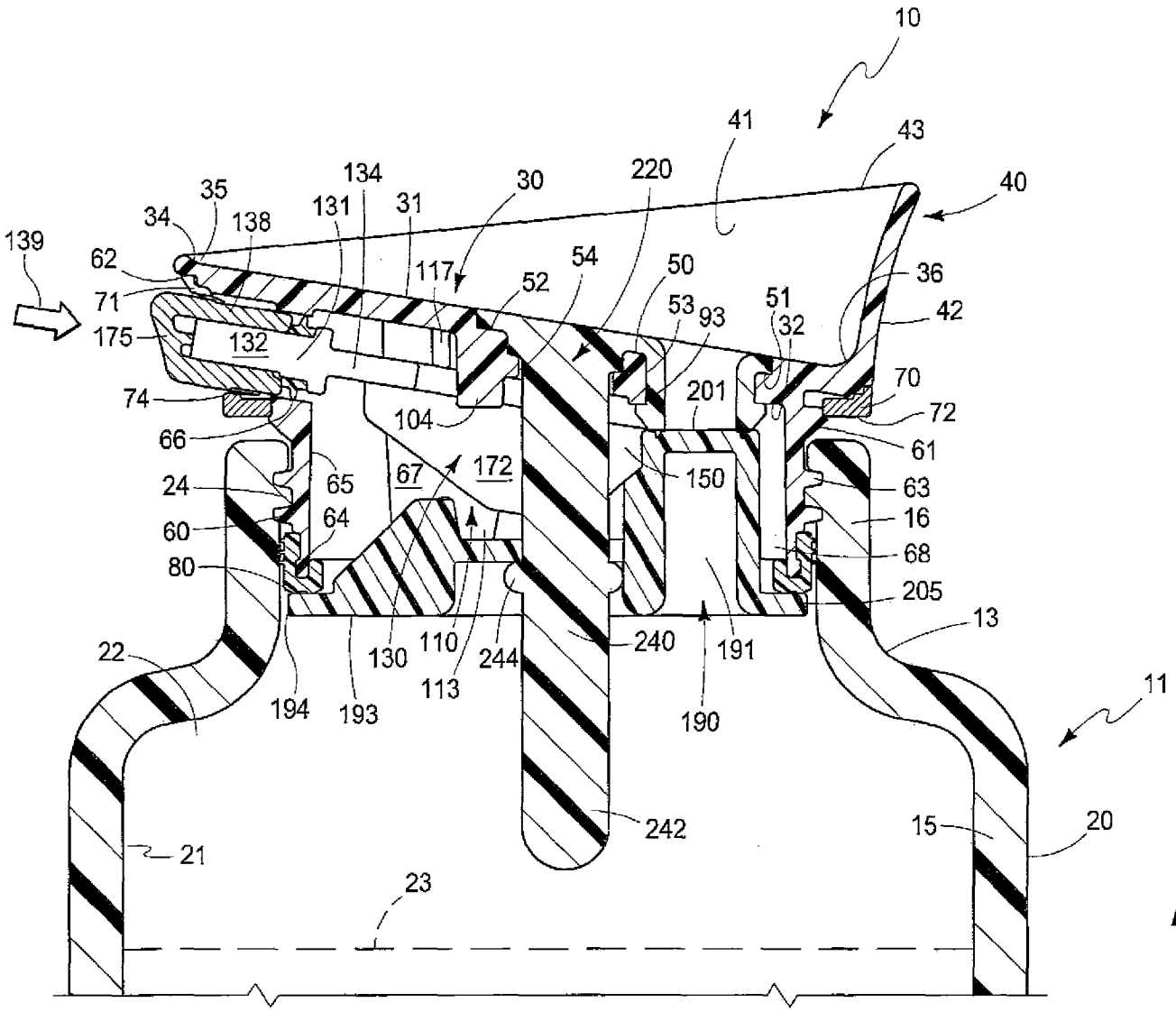
FIG. 1 is a fragmentary, longitudinal vertical sectional view of the present invention, shown in a first operational position.

The present invention relates to a liquid dispensing lid which is generally indicated by the numeral 10 in FIG. 1, and following. As seen in the drawings, the liquid dispensing lid 10 is operable to releasably engage a drinking vessel 11 of conventional design. The drinking vessel 11 has a first end (not shown), and an opposite, second end 13 which releasably engages the liquid dispensing lid 10. The drinking vessel 11 further is defined by a base portion located at the first end, and a circumscribing and continuous sidewall 15 which terminates at a neck 16. The neck allows access to the interior of the drinking vessel 11. The drinking vessel 11 is defined by an outside facing surface 20, and an opposite, inside facing surface 21. The inside facing surface 21, defines an internal cavity 22 having a given volume. The internal cavity 22 is operable to receive and enclose a fluid or liquid to be dispensed, and which is generally indicated by the numeral 23. As seen in the drawings (FIGS. 1 and 2), the inside facing surface 21 of the sidewall 15, in the region of the neck 16, has formed therein screw threads 24, and which are operable to releasably and matingly cooperate with the liquid dispensing lid 10 as will be described in the paragraphs which follow.

Figure 2:
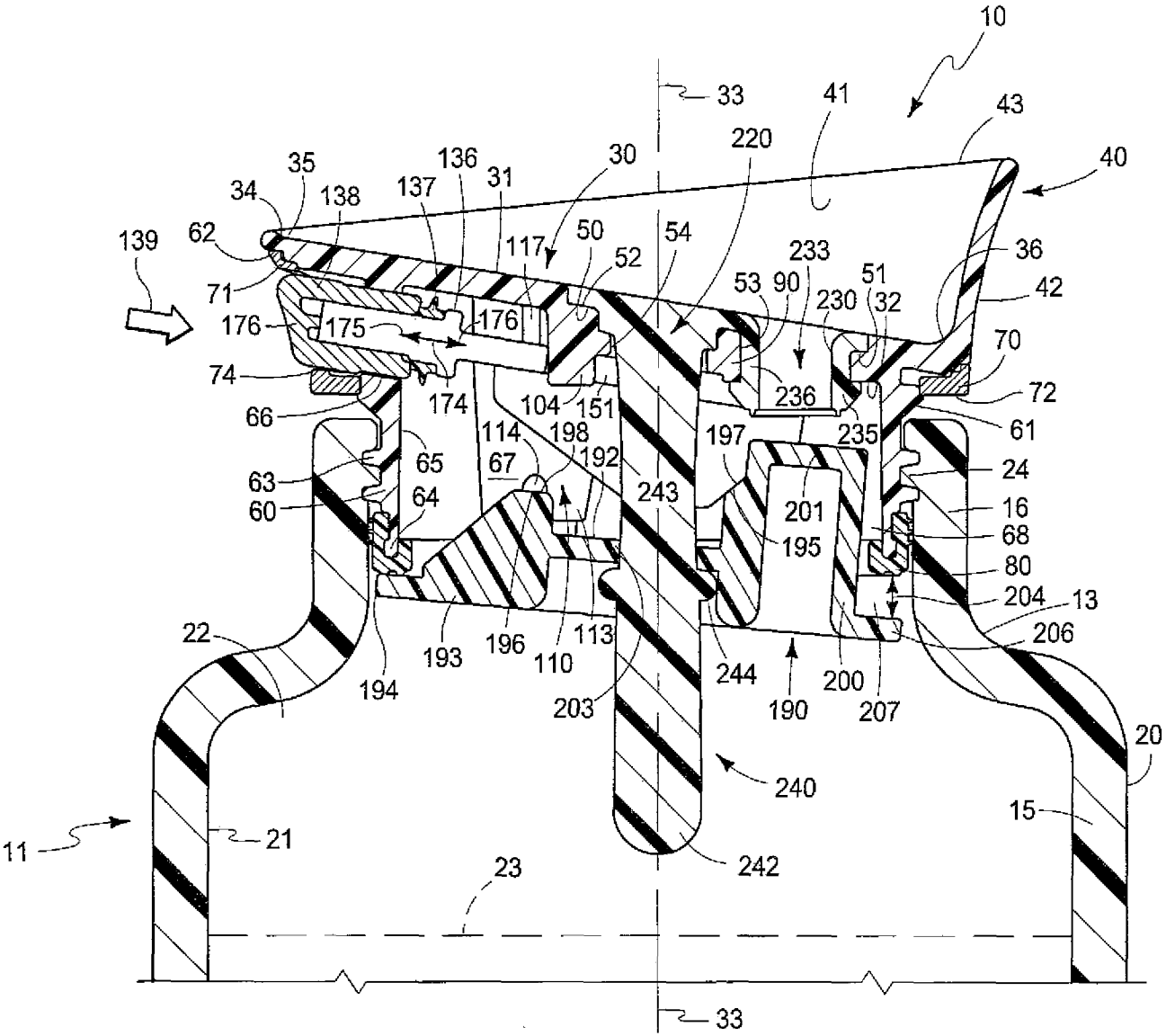
FIG. 2 is a second, fragmentary, longitudinal vertical sectional view of the present invention shown in a second operational position.

The liquid dispensing lid 10 includes a lid body which is generally indicated by the numeral 30. The lid body 30 is defined, in part, by an outwardly or top facing surface 31, and an opposite, bottom facing surface 32. Still further, the lid body 30 is defined, in part, by a longitudinal axis that is generally indicated by the numeral 33 (FIG. 2), and which is substantially, coaxially aligned relative to a longitudinal axis of the drinking vessel 11 when the lid body 30 is matingly cooperating with the neck 16 of the drinking vessel 11. When properly mounted or positioned on the drinking vessel 11, the top surface 31 of the lid body 30 is oriented in a non-horizontal plane as best seen in the drawings (FIGS. 1 and 2). The lid body 30 is defined, in part, by a peripheral edge 34. The peripheral edge 34 has an elevated first portion 35, and a second portion 36 which is positioned elevationally below the first portion 35. As seen in the drawings, the lid body 30 further includes a vertically upwardly extending sidewall which is generally indicated by the numeral 40. The upwardly extending sidewall 40 is made integral with the top surface 31, and extends upwardly and laterally outwardly relative to the top surface 31. The sidewall 40 has an inside facing surface 41, and an outside facing surface 42. Still further, the sidewall 40 has a peripheral edge 43 which is disposed in a non-horizontal orientation. Yet further, it will be recognized that the sidewall 40 extends upwardly relative to the top surface 31 of the lid body 30 to a height dimension which is variable. As seen in the drawings, the height dimension of the sidewall 40 is greatest when measured along the second portion 36 of the peripheral edge 34.

As seen in the drawings, a cavity 50 is formed in the top facing surface 31 of the lid body 30, and is located adjacent to the second portion 36 of the peripheral edge 34. The cavity 50 has a first end 51, and an opposite second end 52 which is disposed radially inwardly relative thereto. A drinking aperture 53 is formed in the first end 51 of the cavity 50, and further extends through the top and bottom surfaces 31 and 32, respectively. As can be seen in the drawings, an elongated coupling aperture 54 is formed in the second end 52 of the cavity 50, and also extends through the top and bottom surfaces 31 and 32 of the lid body. The cavity 50 defines a region which is operable to matingly couple with or receive a biasing member which will be discussed in greater detail, hereinafter.

The lid body 30 is defined, in part, by a downwardly extending sidewall 60 which is made integral with the peripheral edge 34, and which further extends downwardly relative thereto. The downwardly extending sidewall 60 has an exterior facing surface 61. A recessed region 62 having a given shape is formed in the exterior facing surface 61, and is operable to matingly cooperate with a continuous ring member which will be discussed in greater detail, below. Still further, and as seen in the drawings, the exterior facing surface 61 defines, in part, a multiplicity of screw threads 63. The screw threads 63 are operable to screw-threadably cooperate with the screw threads 24, and which are formed in the inside facing surface 21 of the drinking vessel 11, and in the region of the neck 16. Still further, the downwardly extending sidewall 60 is defined, in part, by a distal peripheral edge 64. As seen in the drawings, the downwardly extending sidewall has an inside facing surface 65. The downwardly extending sidewall 60, further defines an actuator aperture 66 which has a predetermined size, and shape, and which is further operable to receive a first force receiving member of an actuator which will be described, below. Still further, the inside facing surface 65, in combination with the bottom facing surface 32 of the lid body 30 defines, in combination, an internal cavity 67 which has given dimensions. As should be understood, the drinking aperture 53, and elongated coupling aperture 54, communicate with the internal cavity 67. The distal peripheral edge 64 defines an aperture 68 which allows communication with the internal cavity 67.

As best seen in the drawings, a continuous ring member, and which is generally indicated by the numeral 70, is sized so as to conformably and matingly interfit or cooperate with the recessed region 62 which is formed in the exterior facing surface 61 of the downwardly extending sidewall 60. The continuous ring member 70 has an outside facing surface 71. In practice, the outside facing surface 71 may have a different colored hue than the surrounding exterior facing surface 61 so as to provide a decorative accent to the exterior facing surface 61. The continuous ring member 70 has a bottom peripheral edge 72. As should be understood, a multiplicity of drain holes (not shown) are formed in the bottom peripheral edge 72, and are operable to allow moisture which might accumulate between the continuous ring member 70, and the exterior facing surface 61, to drain away as might be the case when the lid body 30 is sanitized by means of a dishwasher or the like. Still further, the continuous ring member 70, and more specifically, the outside facing surface 71, defines an aperture 74 which is formed therein, and which further is substantially coaxially aligned with, and sized similar to the actuator aperture 66, and which is formed in the exterior facing surface 61 of the downwardly extending sidewall 60. As seen in the FIGS. 1 and 2, a gasket or other liquid impervious seal 80, of traditional design, is received about the distal peripheral edge 64 of the downwardly extending sidewall 60, and is operable to cooperate with a moveable fluid regulating plate as will be described in greater detail, hereinafter. The gasket or other fluid seal 80 can be removed, by hand, from the distal peripheral edge 64, and then subjected to cleaning so as to maintain the liquid dispensing lid 10 in a sanitary condition.

Referring again to the drawings, the lid body 30 includes a cylindrically shaped wall 90 (FIG. 2) which is mounted on the bottom surface 32 of the lid body 30 and which depends downwardly relatively thereto. The cylindrically shaped sidewall 90 defines a passageway 91 (FIG. 3), and which is substantially coaxially aligned with the drinking aperture 53, and which further extends through the top and bottom surfaces 31 and 32, respectively, of the lid body 30. The cylindrically shaped wall 90 has an exterior facing surface 92 (FIG. 3) which defines an outside diametral dimension for the cylindrically shaped wall 90. As seen in the drawings, the coupling aperture 54 is located in spaced relation relative to the exterior facing surface 92 of the cylindrically shaped wall 90. Further, as seen in the drawings, the cylindrically shaped wall 90 has a distal end 93.

Figure 3:
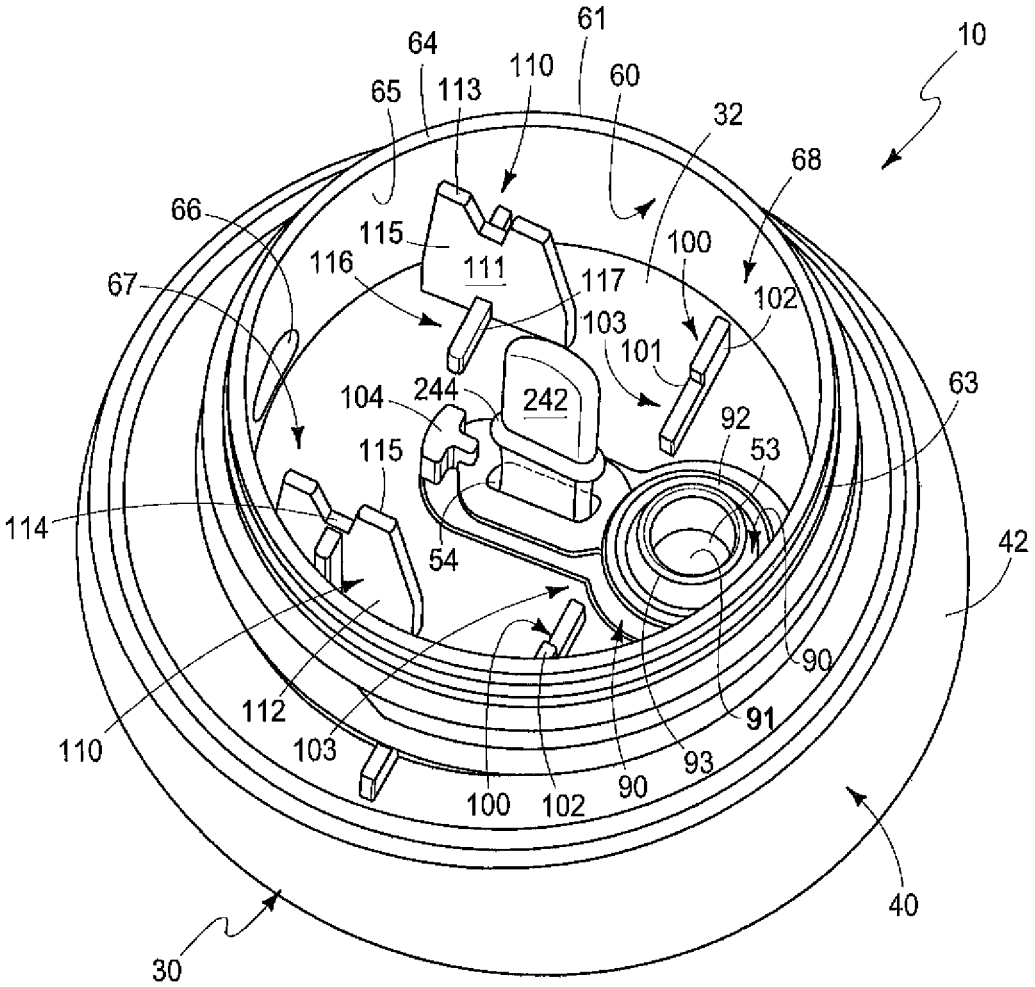
FIG. 3 is a perspective, bottom plan view of the liquid dispensing lid of the present invention.

As will be seen in FIG. 3, a first pair of movement limiting members 100 are made integral with the bottom facing surface 32 of the lid body 30, and depend downwardly therefrom, and are further located in spaced relation, and laterally outwardly relative to the cylindrically shaped wall 90. The respective movement limiting members are defined by a main body 101, and which further has a distal end that is generally indicated by the numeral 102. As should be appreciated from a study of the drawings, the distal ends 102 of the respective movement limiting members 100 define a movement defining channel 103, therebetween. Still further in the arrangement as seen in the drawings, a second movement limiting member 104 is located in adjacent, spaced relationship relative to the coupling aperture 54. As noted earlier, the coupling aperture 54 extends between the top and bottom surfaces 31 and 32, respectively, of the lid body 30. As seen in the drawings (FIG. 3), the second movement limiting member 104 is located in substantial alignment with the elongated coupling aperture 54, and the drinking aperture 53, respectively.

As illustrated in the drawings, a pair of spaced support members 110, which include a first support member 111 (FIG. 3), and a second support member 112, are each respectively made integral with the bottom surface 32 of the lid body 30, and depend downwardly therefrom. Each of the support members 111 and 112, respectively, has a distal end 113 which defines a cradle or recessed region 114 therein. Still further, each of the first and second support members 111 and 112, respectively have a generally vertically oriented sidewall 115 which defines a passageway 116, therebetween the spaced support members 111 and 112, respectively. As seen in the drawings, individual engagement members 117 are made integral with the bottom facing surface 32, and are further coupled to each of the sidewalls 115. The respective engagement members 117 are oriented in a normal or perpendicular relationship relative to each of the sidewalls 115, and further extend into the passageway 116, and which is defined between the two sidewalls 115 of the spaced support member 111 and 112, respectively.

Figure 4:
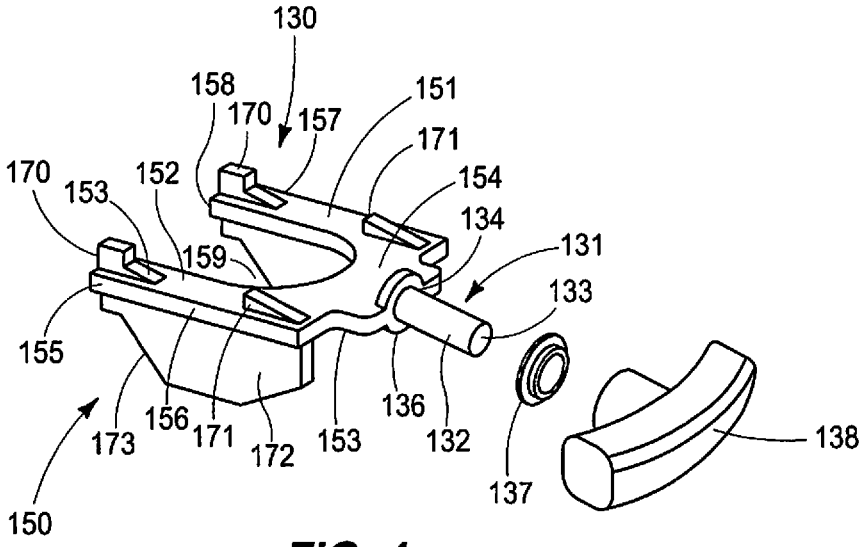
FIG. 4 is a perspective, exploded, side elevation view of an actuator assembly which forms a feature of the present invention.

The liquid dispensing lid 10 of the present invention includes an actuator assembly 130 which is movably borne by the lid body 30, and which is located, at least in part, within the internal cavity 67 of the lid body 30 (FIG. 1). The actuator assembly 130 includes a first force receiving member which is generally indicated by the numeral 131 (FIG. 4). The first force receiving member has a main body 132 which has a first end 133, and an opposite second end 134. As seen in the drawings (FIG. 4), a flange member 136 is formed on the main body 132. Still further, the first force receiving member 131 cooperates with a fluid seal 137, and which is received about the main body 132, and is further disposed in juxtaposed relation relative to the flange member 136. The fluid seal 137 impedes the movement of any fluid or liquid 23 of the drinking vessel 11 from passing through the actuator aperture 66 when the liquid dispensing lid 10 is in operation (FIG. 1). As seen in the drawings (FIG. 4), an exterior cap or member 138 is positioned in mating receipt on the first end 133. A portion of the exterior cap 138 extends radially outwardly from the actuator aperture 66 (FIG. 1), and which is operable to receive a radially inwardly directed exterior force 139 such as might be applied by the finger of a user, while consuming a beverage from the drinking vessel 11. In the arrangement as seen in the drawings, the actuator assembly 130, and more specifically the first force receiving member or portion 131 is operable, when exterior force 139 is applied to same to effect an inwardly directed movement of the first force receiving member in a first direction towards the longitudinal axis. This radially inwardly directed movement of the first force receiving member 131 is effective in transmitting force, as will be described below, in a manner which permits the liquid dispensing lid 10 to be rendered operational, and further allows the liquid 23 to pass from the drinking vessel 11 to the drinking aperture 53.

The actuator assembly 130 includes a second force receiving member or portion 150, and which is coupled in force receiving relation relative to the first force receiving member or portion 131. In this regard, the second force receiving member or portion 150 (FIG. 4) is defined, in part, by a bifurcated main body 151, and which is wholly received within, and is movable relative to the internal cavity 67 of the lid body 30 (FIG. 1). The bifurcated main body 151 has a top surface 152 (FIG. 4) which is disposed in spaced relation relative to the bottom surface 32 of the lid body 30. Still further, the bifurcated main body 151 has a bottom surface 153. Yet further, the bifurcated main body has a first end 154, and a distal, second end 155. Still further, the bifurcated main body is defined, in part, by first and second spaced arms 156 and 157, respectively. Each of the first and second arms has a distal end 158. Still further, and as seen in the drawings, the first and second arms 156 and 157, respectively define a passageway 159, therebetween, and which has a width dimension which is greater than the outside diametral dimension of the cylindrically shaped wall 90 as defined by the exterior facing surface 92 thereof. As should be appreciated, and when assembled, the respective first and second arms 156, and 157 straddle the cylindrically shaped wall 90. Further, the first and second arms 156, and 157 are received and travel within the movement limiting channel 103. As should be understood, the second end 134 of the first force receiving member 131 is made integral with the first end 154 of the bifurcated main body 151. As will be appreciated, therefore, when the exterior force 139 is applied to the first force receiving member 131, this force is transmitted to the second force receiving member 150 to cause a motion of the actuator assembly 130 along a given path of travel which will be discussed, below.

As seen in the drawings (FIG. 4), the second force receiving member 150 further includes movement limiting members which are generally indicated by the numeral 170, and which are further mounted on the top surface 152, of the bifurcated main body 151, and near the distal end 158 of each of the pair of spaced arms 156 and 157, respectively. As seen in FIG. 4, a pair of elevated camming surfaces 171 are located on the first end 154 of the bifurcated main body 151, and on the top surface 152 thereof. A second pair of caroming surfaces 172 are individually made integral with each of the pair of spaced arms 156 and 157, respectively, and which further depend downwardly from the bottom surface 153 of the bifurcated main body 151 of the second force transmitting member 150, and which forms a portion of the actuator assembly 130. Each of the camming surfaces 172 have a sloped peripheral edge 173. As seen in the drawings, the movement limiting members 170 are operable to cooperate with the first pair of movement limiting members 100 which are made integral with the bottom surface 32 of the lid body 30. Still further, the first pair of elevated camming surfaces 171 matingly engage and cooperate with the individual engagement members 117, and which are mounted on the bottom surface 32 of the lid body 30, and which further are disposed in transverse relation relative to the passageway 116, and which is defined between the pair of spaced support members 110. The first pair of elevated camming surfaces 171 are operable to define, at least in part, the course of movement of the actuator assembly 130 as will be described in greater detail, below. The second pair of camming surfaces 172 have a peripheral edge 173 which is angled inclined or otherwise sloped, and which are operable to transmit force to one of a pair of ribs which will be described in greater detail, below. As should be understood, the second force receiving member 150 is coupled to the first force receiving member 131, and is wholly received within the internal cavity 67 which is defined by the lid body 30. The actuator assembly 130 is movable along a reciprocal first path of travel 174 (FIG. 2) from a first, at rest position 175 (FIG. 1), to a second, operational position 176 (FIG. 2). This movement is effected by the exterior force 139, and which is applied to the first force receiving member 130. This exterior force 139 imparts movement to the actuator assembly 130 along the first path of travel 174, from the first, at rest position 175 (FIG. 1), to the second operational position (FIG. 2). In the second operational position 176, the lid body 30 is rendered operable to dispense liquid 23 from the drinking vessel 11, as will be described in greater detail in the paragraphs which follow.

The liquid dispensing lid 10 of the present invention includes a movable fluid regulating plate which is generally indicated by the numeral 190 in the drawings. The movable fluid regulating plate 190 (FIG. 5) has a main body 191, and which includes an inwardly facing surface 192, and an outwardly facing surface 193. The main body is defined by a peripheral edge 194. The main body 191 is sized so as to cooperate with the peripheral edge 64 of the downwardly extending sidewall 60, and rest in fluid sealing cooperation with the gasket 80 which is positioned about the distal peripheral edge 64. As will be discussed, below, the fluid regulating plate 190 is movable along a given path of travel so as to effect the dispensing of the liquid or fluid 23 which is contained within the drinking vessel 11. The movable fluid regulating plate 190 further has a pair of generally vertically extending, and spaced ribs, here indicated as a first rib 195, and a second rib 196, and which are mounted on the inwardly facing surface 192 of the main body 191. Further, each of the first and second spaced ribs 195 and 196 have an upper, force receiving edge 197 and 198, respectively. As should be understood, the second force receiving member 150, of the actuator assembly 130, forcibly cooperates with the upper force receiving edge 197 of the first rib 195 during operation. As should be appreciated, the upper force receiving edge 198 of the second rib 196 is received, and otherwise rotatably cooperates with the respective cradles 114 which form a feature of the pair of spaced support members 110, as earlier described. As will be appreciated from a study of the drawings, the force receiving edge of the first rib 195 is located elevationally above the force receiving edge 198 of the second rib 196. The function of the movable fluid regulating plate 190 will be discussed in greater detail, below.

Figure 5:
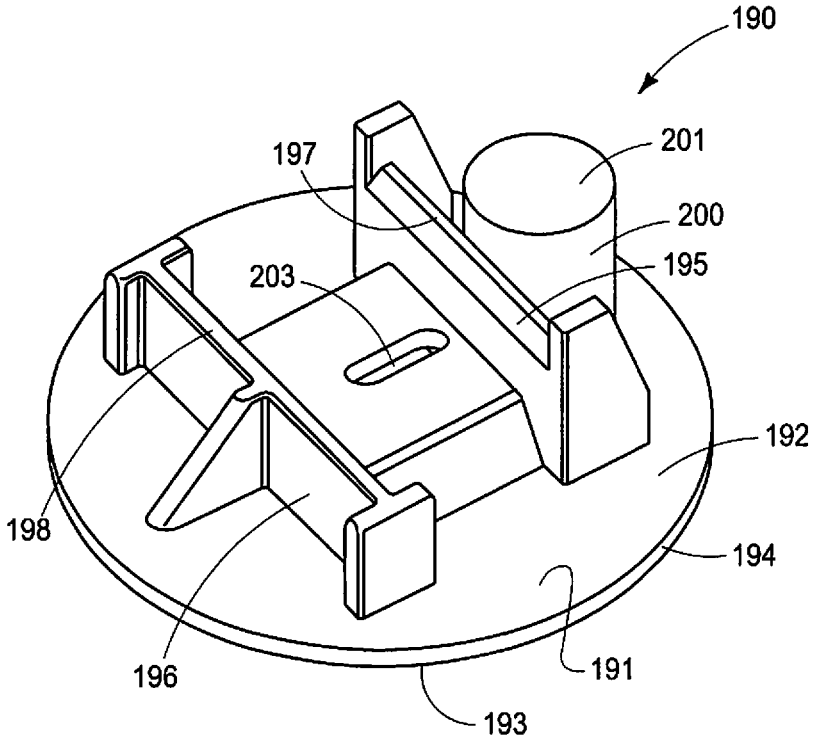
FIG. 5 is a perspective, top plan view of a fluid regulating plate which forms a feature of the present invention.

The movable fluid regulating plate 190 includes a valve member 200 which is mounted, or otherwise made integral with the inwardly facing surface 192 of the main body 191. The valve member has a distal end 201 which has a height dimension equal to or greater than the height dimension of the upper force receiving edge 197 of the first rib 195 (FIG. 5). The valve member 200 is located adjacent to the first rib 195, and in spaced relation relative to the peripheral edge 194. The valve member 200 extends vertically upwardly relative to the inwardly facing surface 192, and is oriented so as to be substantially aligned with the drinking aperture 53, when assembled. As seen in the drawings, a biasing member aperture 203 is formed in, and passes through, the respective inwardly and outwardly facing surfaces 192 and 193, respectively of the main body 191. The biasing member aperture 203, as seen in the drawings, is positioned between the first and second ribs 195 and 196, respectively. As should be understood, the movable fluid regulating plate 190 is operable to move along a second, and somewhat arcuately shaped path of travel 204 (FIG. 2), from a first position 205 (FIG. 1), and where the main body 191 of the movable fluid regulating plate 190 is positioned in fluid sealing engagement with the gasket member 80, and further occludes the internal cavity 67 as defined by the lid body 30, and additionally positions the valve member 200 in occluding relation relative to the drinking aperture 53 as defined by the lid body 30. Still further, the movable fluid regulating plate 190 is movable to a second position 206 (FIG. 2), and where, in the second position, at least a portion of the main body 191 of the movable fluid regulating plate 190 is located in spaced relation relative to the gasket 80 so as to define a gap 207 (FIG. 2), and the valve member 200 is located in a non-occluding relationship relative to the drinking aperture 53. As should be understood, the movable fluid regulating plate 190 when located in the second position 206, along the second path of travel 204, allows the source of liquid or fluid 23 which is enclosed within the fluid engaging vessel 11 to pass from the fluid dispensing vessel 11, and into the internal cavity 67 as defined by the lid body 30, and then further pass through the non-occluded drinking aperture 53. In the arrangement as seen in the drawings, it should be appreciated that the movement of the actuator assembly 130 from the first, at rest position 175 (FIG. 1), to the second, operational position 176 (FIG. 2) effects the movement of the movable fluid regulating plate 190 along the second path of travel 204 from the first position 205, to the second position 206. In this regard, the actuator assembly 130, when moving along the first path of travel 174, causes the second camming surfaces 172 to forcibly cooperate with the force receiving edge 197 of the first rib 195. As should be appreciated, the second camming surfaces 172 causes the fluid regulating plate 190 to move along the second path of travel 204 as force is transmitted to the actuator assembly 130. On the other hand, when the actuator assembly 130 moves from the second position 176 to the first, at rest position 175, it does so by means of a biasing force which is exerted on the fluid regulating plate 190, and as will be discussed in greater detail, hereinafter. As should be appreciated, when the movable fluid regulating plate 190 is in the first position 205, the dispensing of liquid 23 from the fluid dispensing vessel 11 is impeded. However, when the movable fluid regulating plate 190 is located in the second position 206, fluid dispensing is possible.

Figure 6:
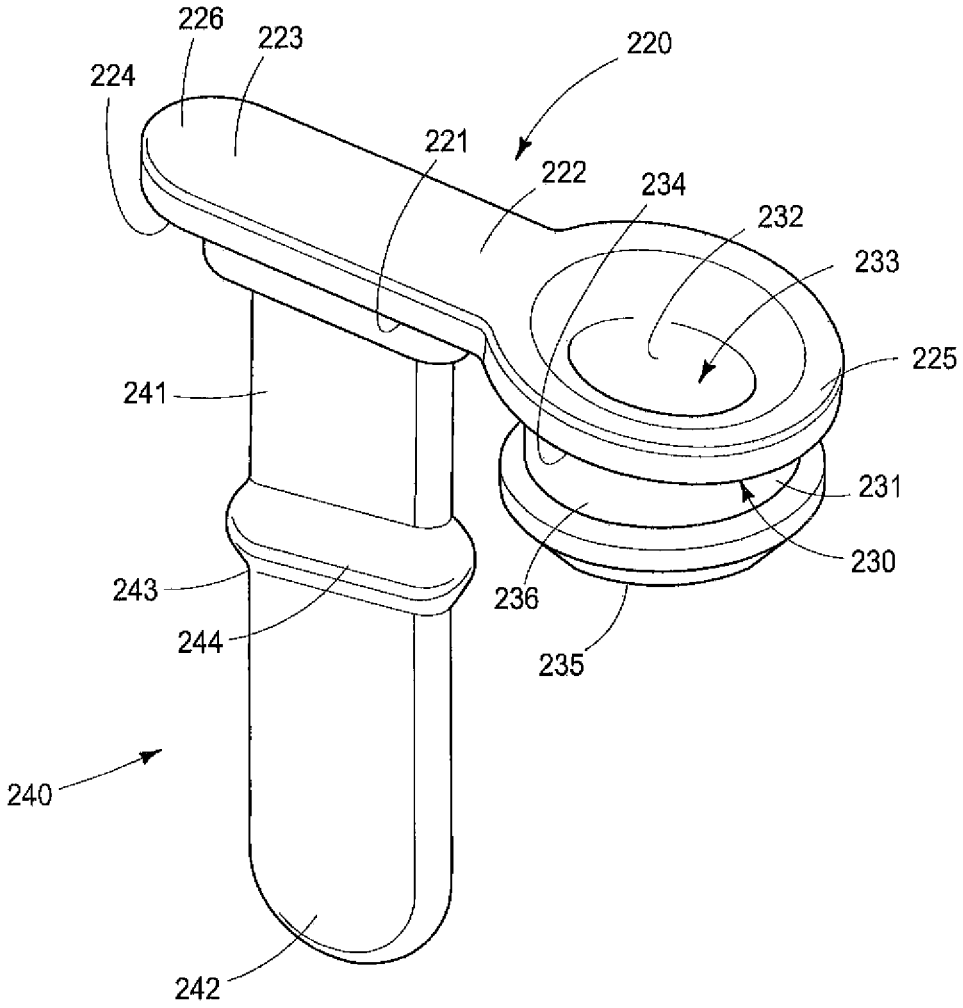
FIG. 6 is a greatly enlarged perspective, side elevation view of a biasing assembly, and which forms a feature of the present invention.

The liquid dispensing lid of the present invention 10 includes a biasing member which is generally indicated by the numeral 220 (FIG. 6). The biasing member 220 has a main body 221 which is mounted on the top surface 31, of the lid body 30, and is further sized to be received within the cavity 50 as earlier described (FIG. 1). The biasing member 220 biasingly cooperates with, and urges the movable fluid regulating plate 190 in the direction of the first position 205, and which is located along the second path of travel 204, and where the fluid regulating plate 190 sealingly engages the gasket member 80 so as to prevent the dispensing of the liquid or fluid 23 from the drinking vessel 11. The main body 221 of the biasing member 220 has a first portion 222 (FIG. 6) which is supported on the lid body 30, and is further located near the top surface 31 thereof. The first portion 222 has a top surface 223, and an opposite, bottom surface 224. The first portion 222 has a first end 225, and an opposite, second end 226. The main body 221 is sized so as to matingly fit within the cavity 50 as formed in the top surface 31 of the lid body. As seen in the drawings (FIG. 2), the top surface 223 is substantially coplanar with the top surface 31 as defined by the lid body 30.

As seen in the drawings, the biasing member 220 includes an elastomeric, cylindrically shaped wall which is generally indicated by the numeral 230, and which further is made integral with the bottom surface 224 of the first portion 222. The elastomeric cylindrically shaped wall 230 has an outside facing surface 231, and an opposite inside facing surface 232. The inside facing surface 232 defines a passageway 233 which extends from the top surface 223, to the distal end of the wall 230. The elastomeric cylindrically shaped wall 231 has a first end 234, which is made integral with the bottom surface 224, and an opposite, second, or distal end 235. The elastomeric cylindrically shaped wall 230 also has an intermediate portion 236 which has a predetermined, outside diametral dimension which is less than the outside diametral dimension of the second, distal end 235. As seen in the drawings, and more specifically to the assembled configuration, the elastomeric, cylindrically shaped wall 230 has an outside diametral dimension when measured at the intermediate portion 236, and which is sized so as to permit the elastomeric cylindrically shaped wall 230 to be telescopingly received within the passageway 91, and which is defined by the cylindrically shaped wall 90, and which is further made integral with the bottom surface 32 of the lid body 30. To permit this arrangement, the second, distal end 235 is resiliently deformed so as to allow it to pass through the passageway 91. When passage is achieved, the passageway 233 is then coaxially aligned with the drinking aperture 53. The distal end 235 extends outwardly relative to the cylindrically shaped wall 90 which is made integral with the bottom surface 32 of the lid 30. Because of its increased outside diametral dimension, the elastomeric cylindrically shaped wall 230 is securely retained within the cylindrically shaped wall 90 which is made integral with the bottom surface 32 of the lid body 30. This arrangement also permits the biasing member 220 to be easily removed from the assembled configuration as seen in the drawings, and then cleansed so as to maintain a sanitary condition of the fluid dispensing lid 10 so it may be used with various liquids of choice by a user of the drinking vessel 11.

The biasing member 220 of the present invention further includes a second, elongated portion 240 which is made integral with the bottom surface 224 of the first portion 222, and which further has a first end 241 which is made integral with the bottom surface 224, and a second, distal end 242 (FIG. 6). The second portion 240 depends downwardly relative to the first portion 222, and further passes through the coupling aperture 54, and extends through the internal cavity 67 of the lid portion 30. The distal end 242 of the second portion 240 further extends through the biasing member aperture 203, and then forcibly cooperates with the fluid regulating plate 190. In this regard, the second portion 240 has an intermediate portion 243 which is located between the first and second ends. Still further, the intermediate portion includes an enlarged engagement member 244 which is made integral therewith, and which further can pass though the aforementioned apertures by being resiliently deformed. When passed through the biasing member aperture 203, the enlarged engagement member 244 is positioned in force transmitting relation relative to the outwardly facing surface 193 of the movable fluid regulating plate 190. The movement of the movable fluid regulating plate 190 along the second path of travel 204 from the first position 205, to the second position 206 is effective in forcibly elongating the second portion 240 (FIG. 2), and more specifically the intermediate portion or region 243 thereof. The fluid regulating plate 190 moves along the second path of travel from the second position 206 to the first position 205 under the biasing force exerted by the second portion 240 of the biasing member 220 when the exterior force is no longer applied to the first force receiving member 131 of the actuator assembly 130.

Operation

The operation of the described embodiment of the present invention is believed to be readily apparent, and is briefly summarized at this point.

A first aspect of the present invention relates to a liquid dispensing lid 10, which includes a lid body 30 having a drinking aperture 53, and which further defines an internal cavity 67. The lid body 30 releasably cooperates with a drinking vessel 11, and which encloses a source of a liquid 23 to be consumed through the drinking aperture 53. An actuator assembly 130 is provided, and which is moveably mounted within the internal cavity 67 of the lid body 30. An external force 139 is applied to the actuator assembly 130, and which is effective to move the actuator assembly 130 along a first path of travel 174. A fluid regulating plate 190 is provided, and which movably cooperates with the lid body 30. The actuator assembly 130 forcibly engages the fluid regulating plate 190 when the external force is applied to the actuator assembly 130 so as to move the fluid regulating plate 190 along a second path of travel 204 from a first position 205, and where the fluid regulating plate impedes the movement of the liquid 23 to the drinking aperture 53, to a second position 206, and which allows liquid movement to the drinking aperture 53. The liquid dispensing lid 10 further includes a biasing member 220 which is mounted on the lid body 30, and which is further coupled to the fluid regulating plate 190. The biasing member 220 biasingly urges the fluid regulating plate towards the first position 205 along the second path of travel 204 when the external force is no longer applied to the actuator assembly 30.

More specifically, the present invention relates to a liquid dispensing lid 10 which includes a lid body 30, having a top surface 31 which has a peripheral edge 34, a bottom surface 32, and a downwardly depending sidewall 60. The bottom surface 32, and the downwardly depending sidewall 60 define an internal cavity 67, and wherein a drinking aperture 53, and a coupling aperture 54 are formed in the top surface 31, and extend through the lid body 30 to the bottom surface 32. An actuator aperture 66 is defined in the downwardly depending sidewall 60 of the lid body 30. The present invention also includes an actuator assembly 130 which is moveably located within the internal cavity 67 as defined by the lid body 30. The actuator assembly 130 includes a first, force receiving member 131 which moveably cooperates, at least in part, with the actuator aperture 68, and which further is defined by the downwardly depending sidewall 60 of the lid body 30. The actuator assembly 130 further includes a second force receiving member 150 which is coupled in force receiving relation relative to the first force receiving member 131. As earlier discussed, an exterior force 134 which is applied to the first actuator assembly 130 causes the second force receiving member 150 to move in a first direction along a first path of travel 174. The liquid dispensing lid 10 further includes a fluid regulating plate 190 which movably cooperates with the lid body 30. The fluid regulating plate 190 has an inwardly facing surface 192 which has a peripheral edge 194. The fluid regulating plate 190 further has a valve member 200 which operably cooperates with the drinking aperture 53. A biasing aperture 203 passes through the fluid regulating plate 190. The second force receiving member 150 of the actuator assembly 130 transmits force to the inwardly facing surface 192 of the fluid regulating plate 190 to move the fluid regulating plate along a second path of travel 204 from a first position 205, which impedes the movement of a fluid 23 into the internal cavity 67 of the lid body 30, and out through the drinking aperture 58; to a second position 206, and where movement of the fluid 23 through the internal cavity 67 of the lid body 30 is permitted. The liquid dispensing lid further includes a biasing member 220 which has a first portion 222, and which is mounted on the lid body 30; and a second portion 240 which is made integral with the first portion 222, and which further extends through the coupling aperture 54 which is formed in the top surface 31. The biasing member 220 has a second distal end 242 which passes through the biasing member aperture 203, and which is formed in the fluid regulating plate 190. The biasing member 220 exerts a biasing force on the fluid regulating plate 190 so as to move the fluid regulating plate 190 in the direction of the first position 205, and along the second path of travel 204, and to urge the actuator assembly 30 to move in an opposite direction along the first predetermined path of travel 174.

Therefore, it will be seen that the present invention provides a convenient means for dispensing a source of a liquid to be consumed. The present liquid dispensing vessel is easy to use, convenient to operate, and is easy to disassemble, and clean thereby rendering the liquid dispensing lid useful with a variety of different beverages, and further operates to prohibit the spilling of liquids or beverages from the drinking vessel when the drinking vessel 11 is not in use.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A liquid dispensing lid for a drinking vessel, the liquid dispensing lid comprising:

a lid body having a drinking aperture, and which further defines an internal cavity, and wherein the lid body is configured to releasably cooperate with the drinking vessel which encloses a source of a liquid to be consumed through the drinking aperture;

an actuator assembly moveably mounted within the internal cavity of the lid body, and wherein an external force applied to the actuator assembly moves the actuator assembly along a first path of travel;

a fluid regulating plate which movably cooperates with the lid body, and wherein the actuator assembly forcibly engages the fluid regulating plate when the external force is applied to the actuator assembly to move the fluid regulating plate along a second path of travel from a first position which impedes movement of liquid to the drinking aperture, to a second position which allows liquid movement to the drinking aperture;

a biasing member mounted on the lid body, and further coupled to the fluid regulating plate, and wherein the biasing member biasinqly urges the fluid regulating plate towards the first position along the second path travel when the external force is no longer applied to the actuator assembly;

and wherein the lid body has a top and bottom surface, and further has a peripheral edge, and wherein the lid body also includes a downwardly depending sidewall which is made integral with the bottom surface of the lid body, and which further has an exterior facing surface which is configured to matingly engage, at least in part, with the drinking vessel, and the downwardly depending sidewall further has an inside facing surface which defines, at least in part, a portion of the internal cavity of the lid body, and wherein the downwardly depending sidewall has a distal peripheral edge, and wherein the lid body further defines a coupling aperture which extends through the top and bottom surfaces, and which further communicates with the internal cavity thereof, and wherein an actuator aperture is formed in the downwardly extending sidewall and communicates with the internal cavity of the lid body;

and wherein the actuator assembly includes a first force receiving member which is received, at least in part, within the actuator aperture defined in the downwardly depending sidewall, and a second force receiving member which is carried within the internal cavity of the lid body, and moveable relative to the internal cavity of the lid body, and wherein the second force receiving member is disposed in force transmitting relation relative to a fluid regulating plate, and wherein the external force which is applied to the first force receiving member moves the fluid regulating plate along the second path of travel between the first and second positions;

a gasket which is coupled to the distal peripheral edge of the downwardly depending sidewall;

and wherein the fluid regulating plate has an inside facing surface, an outside facing surface, and a peripheral edge, and wherein the peripheral edge of the fluid regulating plate sealable cooperates with the gasket when the fluid regulating plate is disposed in the first position along the second path of travel, and wherein a valve member is made integral with the inside facing surface of the fluid regulating plate, and is further operable to substantially occlude the drinking aperture when the fluid regulating plate is located in the first position along the second path of travel;

and wherein a pair of spaced support members are made integral with the bottom facing surface of the lid body, and further depend downwardly therefrom, and wherein each of the spaced support members have a distal end defining a cradle, and wherein each of the spaced support members has a sidewall which defines a passageway therebetween, and wherein the second force receiving member of the actuator assembly is received, at least in part, within, and is moveable along, the passageway which is defined between the respective spaced, support members, and wherein a pair of spaced ribs are made integral with the inside facing surface of the fluid regulating plate, and wherein one of the pair of spaced ribs rests within the individual cradles as defined by the individually spaced support members, and wherein the second force receiving member of the actuator assembly forcibly movably engages the other of the pair of spaced ribs so as to move the fluid regulating plate from the first position to the second position along the second path of travel.

2. The liquid dispensing lid for a drinking vessel as claimed in claim 1, and wherein a cavity is formed in the top surface of the lid body, and wherein the drinking aperture is formed in the cavity, and wherein the coupling aperture which is formed in the top surface of the lid body is located within the cavity thereof, and wherein the biasing member has a first portion which is sized so as to be matingly received within the cavity which is formed in the top surface, and further has an elastomeric second portion which is made integral with the first portion, and which has a distal end, and wherein the second portion of the biasing member is sized so as to pass through the coupling aperture and be received, at least in part, within the internal cavity as defined by the lid body, and wherein a second biasing aperture is formed in the fluid regulating plate, and is further located between the pair of spaced ribs, and wherein the distal end of the second portion of the biasing member passes through the biasing aperture, and forcibly acts upon the movable fluid regulating plate, and wherein the biasing member is effective in applying a biasing force which biasingly urges the movable fluid regulating plate towards the first position along the second path oftravel.

3. The liquid dispensing lid for a drinking vessel as claimed in claim 2, and wherein the pair of spaced ribs include a first rib having a predetermined height dimension, and a second rib which has a second height dimension that is less than the height dimension of the first rib, and wherein the second rib matingly cooperates, and rests within the respective cradles as defined by the spaced support members, and wherein the second force receiving member of the actuator assembly further includes a pair of spaced camming members which depend downwardly relative to the second force receiving member of the actuator assembly, and which forcibly engage the first rib, and wherein the external force applied to the first force receiving member of the actuator assembly causes the second force receiving member to move along the first path of travel and to transmit the external force to the first rib so as to effect the movement of the fluid regulating plate along the second path of travel from the first position to the second position, and wherein the biasing member is effective in moving the fluid regulating plate from the second position to the first position along the second path of travel when the external force is removed from the first force receiving member of the actuator assembly, and wherein the first rib rotates, at least in part, within the respective cradles as the fluid regulating plate moves along the second path of travel between the first and second positions.

4. The liquid dispensing lid for a drinking vessel as claimed in claim 3, and further comprising a fluid seal which is borne by the first force receiving member of the actuator assembly, and which further impedes the movement of the liquid which is received within the internal cavity of the lid body from passing through the actuator aperture.

5. The liquid dispensing lid for a drinking vessel as claimed in claim 4, and wherein the second portion of the biasing member has an intermediate portion which is located between the first portion, and the distal end thereof, and wherein the intermediate portion elongates when the fluid regulating plate moves from the first position to the second position along the second path of travel.

6. A liquid dispensing lid for a drinking vessel, the liquid dispensing lid comprising:

a lid body having a top surface which has a peripheral edge, a bottom surface, and a downwardly depending sidewall, and wherein the bottom surface and the downwardly depending sidewall define an internal cavity, and wherein a drinking aperture, and a coupling aperture are formed in the top surface, and extend through the lid body to the bottom surface thereof, and wherein an actuator aperture is defined in the downwardly depending sidewall of the lid body;

an actuator assembly moveably carried within the internal cavity defined by the lid body, and wherein the actuator assembly includes a first force receiving member which moveably cooperates with the actuator aperture which is defined by the downwardly depending sidewall of the lid body, and a second force receiving member which is coupled in force receiving relation to the first force receiving member, and wherein an external force applied to the first force receiving member causes the first force receiving member to move in a first, predetermined direction along a first path of travel;

a fluid regulating plate which moveably cooperates with the lid body, and wherein the fluid regulating plate has an inwardly facing surface which has a peripheral edge, and wherein the inwardly facing surface further includes a valve member which operably cooperates with the drinking aperture, and wherein a biasing member aperture is formed in, and passes through the fluid regulating plate, and wherein the second force receiving member of the actuator assembly transmits force to the inwardly facing surface of the fluid regulating plate so as to move the fluid regulating plate along a second path of travel from a first position which impedes the movement of a liquid into the internal cavity of the lid body, and out through the drinking aperture, to a second position, and where movement of the liquid through the internal cavity of the lid body is permitted;

a biasing member having a first portion which is mounted on the lid body, and a second portion which is made integral with the first portion, and which further extends through the coupling aperture formed in the top surface of the lid body, and wherein the biasing member has a distal end which passes through the biasing member aperture which is formed in the fluid regulating plate, and which further exerts a biasing force on the fluid regulating plate so as to move the fluid regulating plate in the direction of the first position along the second path of travel, and to further urge the actuator assembly to move in an opposite direction along the first predetermined path of travel;

and wherein the downwardly depending sidewall, which is integral with the bottom surface of the lid body, has a distal peripheral edge, and wherein a gasket is mounted on the distal peripheral edge, and the gasket selectively and sealable engages the inwardly facing surface of the fluid regulating plate; and wherein the second path of travel of the fluid regulating plate is arcuately shaped, and wherein at least a portion of the peripheral edge of the fluid regulating plate remains in sealable contact with the gasket when the fluid regulating plate is in the second position along the second path of travel.

7. A liquid dispensing lid for a liquid dispensing vessel, the liquid dispensing lid, comprising:

a lid body having a top, outwardly facing surface, an opposite, bottom facing surface, and which is further defined by a longitudinal axis, and wherein the lid body is also defined, at least in part, by a peripheral edge, and wherein a sidewall extends generally vertically upwardly relative to the peripheral edge of the top surface, and further has a variable height dimension when measured from the top surface of the lid body, and wherein the lid body further has a downwardly extending sidewall which is mounted on the bottom surface, and which depends downwardly relative thereto, and wherein the downwardly extending sidewall has an exterior facing surface, and an opposite interior facing surface, and wherein the downwardly extending sidewall further has a distal peripheral edge which defines an aperture for an internal cavity of the lid body, and wherein the bottom surface of the lid body, and the interior facing surface of the downwardly extending sidewall, in combination, define the internal cavity of the lid body, and wherein the exterior facing surface of the downwardly extending sidewall of the lid body is sized so as to releasably cooperate with an open aperture of a liquid dispensing vessel having an internal cavity and which encloses a source of a liquid to be dispensed, and wherein the lid body further defines a drinking aperture, and a second, coupling aperture, each of which extends through the top and bottom surfaces of the lid body, and further communicate with the internal cavity of the lid body, and wherein the downwardly extending sidewall of the lid body additionally defines an actuator aperture which is located below the top surface of the lid body, and laterally, outwardly, relative to the longitudinal axis thereof;

a continuous ring member which matingly, and circumscribingly cooperates, at least in part, with the lid body, and is further positioned laterally, outwardly relative to the longitudinal axis of the lid body, and wherein the continuous ring member further defines an aperture which is substantially coaxially aligned relative to the actuator aperture of the lid body;

an actuator assembly which is moveably borne by the lid body, and which is located, at least in part, within the internal cavity of the lid body, and wherein the actuator assembly includes a first, force receiving member which is matingly, and moveably received within the actuator aperture, and which further extends, at least in part, laterally outwardly relative to the peripheral edge of the top surface of the lid body, and wherein an exterior force applied to the first, force receiving member effects an inwardly directed movement of the first, force receiving member in a direction towards the longitudinal axis, and wherein the actuator assembly further includes a second, force receiving member which is coupled to the first, force receiving member, and which further is carried within the internal cavity which is defined by the lid body, and wherein the actuator assembly is moveable along a reciprocal, first path of travel, from a first, at rest position, to a second, operational position, and wherein the exterior force applied to the first, force receiving member is effective in moving the actuator assembly along the first path of travel from the first, at rest position, to the second, operational position;

a gasket which is fluid-sealingly mounted on, and about, the distal peripheral edge of the downwardly depending sidewall of the lid body, and wherein the gasket is effective in impeding movement of the liquid from the internal cavity of the liquid dispensing vessel into the internal cavity as defined by the lid body when the actuator assembly is in the first, at rest position;

a moveable fluid regulating plate having a main body which is defined by an inwardly facing surface, an outwardly facing surface, and a peripheral edge, and wherein a pair of generally vertically, upwardly extending, and spaced ribs are mounted on the inwardly facing surface of the main body and which further each have an upper, force receiving edge, and wherein the second force receiving member of the actuator assembly forcibly cooperates with the upper, force receiving edge of one of the spaced ribs, and wherein a valve member is further mounted on the inwardly facing surface of the moveable base plate, and further extends vertically upwardly relative thereto, and wherein a biasing member aperture is formed in, and passes through, the respective inwardly and outwardly facing surfaces of the movable fluid regulating plate, and wherein the moveable fluid regulating plate is further operable to move along a second path of travel from a first position, and where the main body of the moveable fluid regulating plate is positioned in fluid sealing engagement with the gasket member, and further occludes the internal cavity as defined by the lid body, and additionally positions the valve member in occluding relation relative to the drinking aperture as defined by the lid body, to a second position, and wherein in the second position, at least a portion of the main body of the moveable fluid regulating plate is located in spaced relation relative to the gasket, and the valve member is located in non-occluding relation relative to the drinking aperture, and wherein the moveable fluid regulating plate, when located in the second position along the second path of travel allows the source of the liquid enclosed within the liquid dispensing vessel to pass from the liquid dispensing vessel, into the internal cavity as defined by the lid body, and then pass through the non-occluded drinking aperture, and wherein movement of the actuator assembly from the first, at rest position, to the second operational position, effects the movement of the moveable fluid regulating plate along the second path of travel from the first position to the second position; and a biasing member having a main body which is mounted on the top surface of the lid body, and which further biasingly cooperates with, and urges the moveable fluid regulating plate in the direction of the first position, and which is located along the second path of travel, and where, in the first position, the fluid regulating plate sealingly engages the gasket member, and wherein the main body of the biasing member has a first portion which is supported on the lid body, and is further located near the top surface thereof, and wherein the biasing member further includes a second, elongated portion which is made integral with the first portion, and which further has a distal end, and wherein the second portion depends downwardly relative to the first portion, and further passes through the coupling aperture, and extends through the internal cavity of the lid portion, and wherein the distal end of the second portion further extends through the biasing member aperture, and forcibly cooperates with the fluid regulating plate, and wherein the movement of the moveable fluid regulating plate along the second path of travel from the first position, to the second position, is effective in forcibly elongating the second portion of the biasing member, and wherein the fluid regulating plate moves along the second path of travel from the second position to the first position under the biasing force exerted by the second portion of the biasing member when the exterior force is no longer applied to the first force receiving member of the actuator assembly.

8. The liquid dispensing lid for a liquid dispensing vessel as claimed in claim 7, and wherein the top surface of the lid body is oriented in a non-horizontal plane when the liquid dispensing lid is releasably coupled with the liquid dispensing vessel, and wherein the peripheral edge thereof has a first elevated portion, and an opposite, second, portion which is located elevationally below the first portion, and wherein the drinking aperture is located adjacent to the second portion of the peripheral edge, and wherein the sidewall which extends upwardly relative to the top surface of the lid body has a height dimension which is greatest when measured at a location adjacent to the drinking aperture.

9. The liquid dispensing lid for a liquid dispensing vessel as claimed in claim 8, and wherein a pair of spaced support members are made integral with the bottom facing surface of the lid body and depend, downwardly therefrom, and wherein each of the support members has a distal end defining a cradle, and individual sidewalls which define a passageway therebetween, and wherein individual engagement members are made integral with the bottom facing surface, and which further are coupled to each of the sidewalls, and wherein the respective engagement members are oriented in a perpendicular orientation relative to each sidewall, and further extend into the passageway which is defined between the two sidewalls of the spaced support members.

10. The liquid dispensing lid for a liquid dispensing vessel as claimed in claim 9, and wherein a cylindrically shaped wall is mounted on the bottom surface of the lid body, and depends downwardly relative thereto, and wherein the cylindrically shaped sidewall defines a passageway which extends therethrough, and which further is substantially coaxially aligned with the drinking aperture, and which extends through the top and bottom surfaces of the lid body, and wherein the cylindrically shaped wall has an exterior facing surface which defines an outside diametral dimension of the cylindrically shaped wall, and wherein the coupling aperture is located in spaced relation relative to the exterior facing surface of the cylindrically shaped wall.

11. The liquid dispensing lid for a liquid dispensing vessel as claimed in claim 10, and wherein a pair of first movement limiting members are made integral with the bottom facing surface of the lid body, and depend downwardly therefrom, and are further located in spaced relation, and laterally outwardly relative to the cylindrically shaped wall, and wherein the respective first movement limiting members each have a distal end which defines a movement defining channel therebetween, and wherein a second movement limiting member is made integral with the bottom facing surface of the lid body and is located in an adjacent, spaced relationship relative to the coupling aperture which extends between the top and bottom surfaces of the lid body.

12. The liquid dispensing lid for a liquid dispensing vessel as claimed in claim 11, and wherein the first portion of the biasing member has a top and bottom surface, and opposite first and second ends, and wherein the second portion of the biasing member depends downwardly relative to the bottom surface of the first portion of the biasing member, and wherein the biasing member further includes an elastomeric, cylindrically shaped wall which defines a passageway extending therethrough, and which further depends from the bottom surface thereof, and wherein the elastomeric cylindrically shaped wall has an outside diametral dimension which is sized so as to permit the cylindrically shaped wall to be telescopingly received within the passageway as defined by the cylindrically shaped wall, and which is made integral with the bottom surface of the lid body, and which further is coaxially aligned with the drinking aperture, and wherein the elastomeric cylindrically shaped wall has a distal end which extends outwardly relative to the cylindrically shaped wall, and which is made integral with the bottom surface of the lid body.

13. The liquid dispensing lid for a liquid dispensing vessel as claimed in claim 12, and wherein the second, force transmitting member of the actuator assembly has a bifurcated main body which is received within, and is moveable relative to, the internal cavity of the lid body, and wherein the bifurcated main body has a top and bottom surface; opposite first and second ends; and a pair of spaced arms, and wherein each of the spaced arms have a distal end, and wherein the first force receiving member of the actuator assembly is coupled in force transmitting relation relative to the second force located receiving member, and wherein individual movement limiting members are mounted on the top surface of the bifurcated main body, and near the distal end of each of the pair of spaced arms, and wherein a first pair of camming surfaces are located on the first end of the bifurcated main body, and on the top surface thereof, and wherein a second pair of camming surfaces are individually made integral with each of the respective pair of spaced arms, and depend downwardly from the bottom surface of the bifurcated main body of the second force receiving member of the actuator assembly, and wherein the pair of spaced arms define a passageway therebetween, and which has a first and second end, and which further has a transverse dimension which is greater than the outside diametral dimension as defined by the cylindrically shaped wall which depends from the bottom surface of the lid body.

14. The liquid dispensing lid for a liquid dispensing vessel as claimed in claim 13, and wherein the pair of spaced ribs which are made integral with the inside facing surface of the fluid regulating plate includes a first rib, and a second rib, and wherein the first rib has a force receiving edge which is located elevationally above a force receiving edge defined by the second rib, and wherein the biasing member aperture which is formed in the fluid regulating plate is located between the first and second ribs, and wherein the valve member is located adjacent to the first rib, and further extends upwardly relative to the inside facing surface of the fluid regulating plate to a height dimension which is equal to or greater than a height dimension of the force receiving edge of the first rib, and wherein the second camming surfaces of the bifurcated main body rest in engagement relative to the force receiving edge of the first rib, and the force receiving edge of the second rib is received in, and rotatably cooperates with the cradle which is defined by the respective support members, and which depend from the bottom surface of the lid body.

15. The liquid dispensing lid for a liquid dispensing vessel as claimed in claim 14, and wherein the actuator assembly when moving along the first path of travel causes the respective second camming surfaces to forcibly cooperate with the force receiving edge of the first rib, and wherein the action of the second camming surfaces cause the fluid regulating plate to move along the second path of travel, and wherein when the actuator assembly moves from the second position to the first position along the first path of travel, a biasing force exerted on the fluid regulating plate biasingly urges the fluid regulating plate from a displaced unsealed position relative to the lid body, back to an orientation where the fluid regulating plate inhibits the dispensing of fluid through the lid body.

* * * * *